United States Patent [19]

Abdulally

[11] Patent Number: 5,072,696

[45] Date of Patent: Dec. 17, 1991

[54] FURNACE TEMPERATURE CONTROL METHOD FOR A FLUIDIZED BED COMBUSTION SYSTEM

[75] Inventor: Iqbal F. Abdulally, Randolph, N.J.

[73] Assignee: Foster Wheeler Energy Corporation

[21] Appl. No.: 626,134

[22] Filed: Dec. 11, 1990

[51] Int. Cl.[5] ..... B09B 3/00; F22B 1/00

[52] U.S. Cl. ..... 122/4 D; 122/6 A; 165/104.16; 165/1

[58] Field of Search ..... 122/4 D, 6 A, DIG. 13; 165/1, 104.16; 110/245

[56] References Cited

U.S. PATENT DOCUMENTS 4,548,162 10/1985 Palkes ..... 122/6 A X 4,936,230 6/1990 Feugier et al. ..... 122/4 D X

*Primary Examiner*—Edward G. Favors

*Attorney, Agent, or Firm*—Marvin A. Naigur

[57] ABSTRACT

A fluidized bed combustion method in which a recycle heat exchanger is located adjacent the furnace of the combustion system. A mixture of flue gases and entrained particulate materials from a fluidized bed in the furnace are separated and the flue gases are passed to a heat recovery section and the separated particulate material are passed back to the furnace. The walls of the furnace are formed by water tubes, and refractory metal material is placed adjacent the walls to control the heat absorption by the water passing through the tubes. The amount of refractory is selected in accordance with the desired operating temperature of the furnace.

4 Claims, 1 Drawing Sheet

FURNACE TEMPERATURE CONTROL METHOD FOR A FLUIDIZED BED COMBUSTION SYSTEM

BACKGROUND OF THE INVENTION

This invention relates to a fluidized bed combustion system and method and, more particularly, to a method for controlling the temperature in the furnace section of the system.

Fluidized bed combustion systems are well known. In these arrangements, air is passed through a bed of particulate material, including a fossil fuel such as coal and an adsorbent for the sulfur generated as a result of combustion of the coal, to fluidize the bed and to promote the combustion of the fuel at a relatively low temperature. Water is passed in a heat exchange relationship to the fluidized bed to generate steam. The combustion system includes a separator which separates the entrained particulate solids from the gases from the fluidized bed in the furnace section and recycles them back into the bed. This results in an attractive combination of high combustion efficiency, high sulfur adsorption, low nitrogen oxides emissions and fuel flexibility.

The most typical fluidized bed utilized in the furnace section of these type systems is commonly referred to as a "bubbling" fluidized bed in which the bed of particulate material has a relatively high density and a well-defined, or discrete, upper surface. Other types of fluidized beds utilize a "circulating" fluidized bed. According to this technique, the fluidized bed density may be below that of a typical bubbling fluidized bed, the air velocity is equal to or greater than that of a bubbling bed, and the flue gases passing through the bed entrain a substantial amount of the fine particulate solids to the extent that they are substantially saturated therewith.

Circulating fluidized beds are characterized by relatively high solids recycling which makes them insensitive to fuel heat release patterns, thus minimizing temperature variations, and therefore, stabilizing the emissions at a low level. The high solids recycling improves the efficiency of the mechanical device used to separate the gas from the solids for solids recycle, and the resulting increase in sulfur adsorbent and fuel residence times reduces the adsorbent and fuel consumption. In some of these arrangements a recycle heat exchanger is located between the solids separator and the furnace section for cooling the solids before they are recycled back to the furnace section.

The heat transfer, and therefore the temperature, in the furnace section is dependent on the solids loading pattern along the entire furnace height and the furnace is usually conservatively sized from a thermal standpoint to achieve better combustion and sulfur reduction. The solids loading is, in turn, a function of several parameters such as ash and sulfur content in the fuel, fuel and sorbent (limestone) size distribution, furnace gas velocities, combustion air flow distribution, cyclone efficiency and furnace configuration. As a result, it is not always possible to accurately predict the heat transfer rate and therefore the furnace temperature. This is undesirable since in order to ensure optimum sulfur capture the furnace temperature should be within a fairly narrow range which typically is 1500-1640° F. When the furnace temperature is outside this range the sulphur capture efficiency plummets resulting in high sulfur sorbent consumption. Also, fuel burnup efficiency is affected at low furnace temperatures.

Although the furnace absorption and temperature can be varied by varying the external heat exchanger duty, the flue gas recirculation, the amount of spray water, or the amount of sand feed, these techniques are expensive and less desirable from an operational standpoint.

SUMMARY OF THE INVENTION

It is therefore an object of the present invention to provide a fluidized bed combustion system and method which the furnace temperature and duty can be regulated in a precise, efficient and relative inexpensive manner.

It is a further object of the present invention to provide a system and method of the above type in which optimum furnace absorption can be achieved.

It is a further object of the present invention to provide a system and method of the above type in which furnace absorption can be adjusted in order to ensure that the furnace operates at optimum temperature.

It is a further object of the present invention to provide a system and method of the above type in which optimum furnace temperature can be achieved without the need for varying the external heat exchange duty, the flue gas recirculation, the amount of spray water, or the amount of sand feed.

Toward the fulfillment of these and other objects, according to the system and method of the present invention the furnace absorption, and therefore the furnace temperature, is optimized by optimizing the size of the refractory material above the air grid and in the reaction zone of the furnace.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawing wherein.

DESCRIPTION OF THE PREFERRED EMBODIMENT

Figure 1:
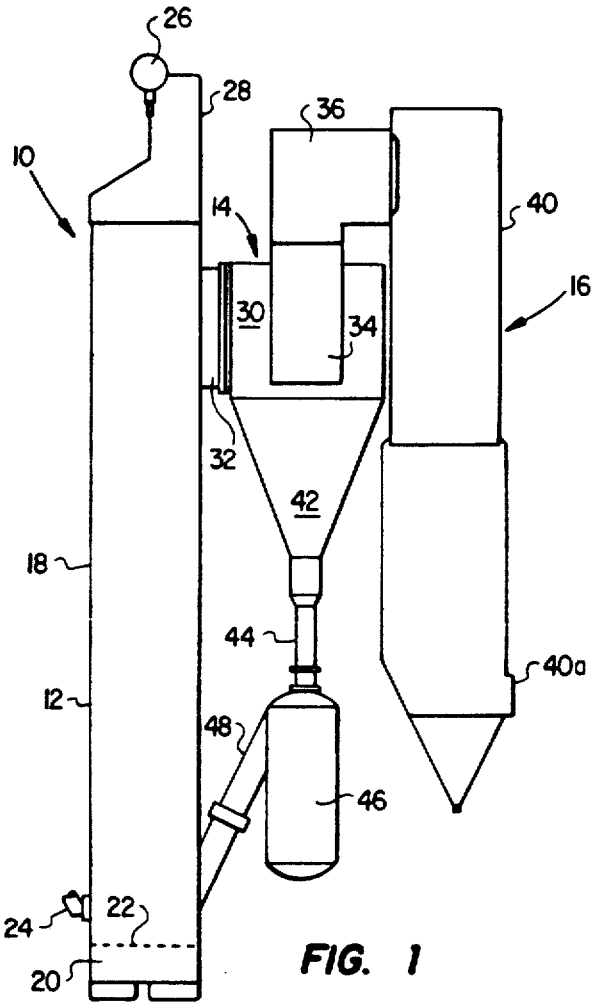
FIG. 1 is a schematic representation depicting the system of the present invention.

Referring specifically to FIG. 1 of the drawings, the reference numeral 10 refers, in general, to the fluidized bed combustion system of the present invention which includes a furnace section 12, a separating section 14, and a heat recovery area 16. The furnace section 12 includes an upright enclosure 18 and an air plenum 20 disposed at the lower end portion of the enclosure for receiving air from an external source. An air distributor, or grate, 22 is provided at the interface between the lower end of the enclosure 18 and the air plenum 20 for allowing the pressurized air from the plenum to pass upwardly through the enclosure 18. An air inlet 24 extends through a wall of the enclosure for introducing secondary air into a reaction zone located just above the air distributor 22.

It is understood that particulate material is supported on the air distributor 22 and the one or more inlets (not shown) are provided through the walls of the enclosure 18 for introducing the particulate material into the bed. The air from the plenum 20 fluidizes the particulate material in the enclosure and a drain pipe (not shown) registers with an opening in the air distributor 22 and/or walls of the enclosure 18 for discharging spent particulate material from the bed enclosure. The particulate material can include coal and relatively fine particles of an adsorbent material, such as limestone, for adsorbing the sulfur generated during the combustion of the coal, in a known manner.

It is understood that the walls of the enclosure 1 include a plurality of water tubes disposed in a vertically extending relationship and that flow circuitry, including a steam drum 26 and downcomer 28, is provided to pass water through the tubes to convert the water to steam. It is understood that headers are provided at the ends of the walls of the enclosure 18*a* at other appropriate locations to form a fluid flow circuit.

The separating section 14 includes one or more cyclone separators 30 provided adjacent the enclosure 18 and connected thereto by a dust 32 extending between openings formed in the upper portion of the rear wall of the enclosure 18 and the separator 30, separately. The separator 30 receives the flue gases and entrained particulate material from the enclosure 18 and operates in a conventional manner to disengage the particulate material from the flue gases due to the centrifugal forces created in the separator. The separated flue gases pass from the separator 30 via an inner pipe 34 and a duct 36 into an opening formed in the upper portion of the heat recovery area 16.

The heat recovery area 16 includes an enclosure 40 which houses a superheater, a reheater and an economizer (not shown), all of which are formed by a plurality of heat exchange tubes extending in the path of the gases that pass through the enclosure 40. The superheater, the reheater and the economizer all are connected to the above-mentioned fluid flow circuitry, including the steam drum 26, and receive heated water or vapor for further heating. After passing through the heat recovery area and, the gases exit the enclosure 40 through an outlet 40*a* formed in the rear wall thereof.

The separated solids from the separator 30 pass into a hopper 42 connected to the lower end of the separator and then into a dipleg 44 connected to the outlet of the hopper. The dipleg 44 extends into a seal pot 46 and a conduit 48 extends from the seal pot to the rear wall of the enclosure 18. Separated particulate material from the separator 30 thus passes, via the dipleg 44, into the seal pot 46 and accumulates in the seal pot before passing, via the conduit 48, back into the furnace section 12. The seal pot 46 thus seals against backflow of the air and gas products of combustion with entrained particulate material from the furnace section directly to the separator 30.

Figure 2:
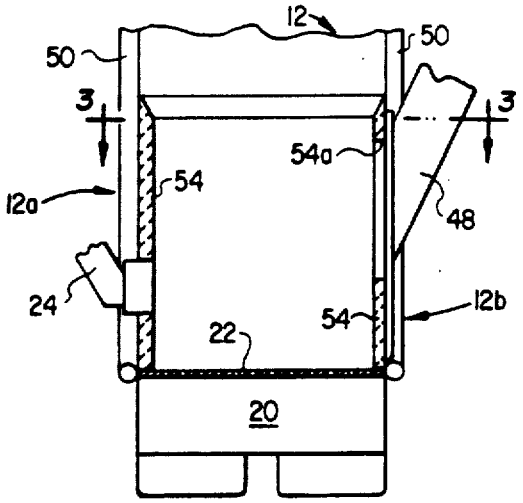
FIG. 2 is an enlarged, partial, longitudinal sectional view of the lower portion of the furnace section of the system of FIG. 1.
Figure 3:
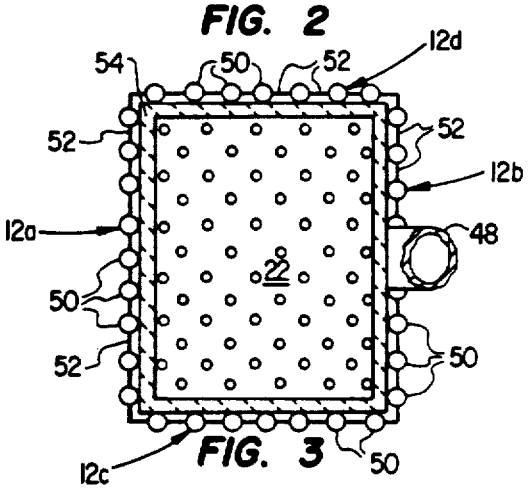
FIG. 3 is a cross-sectional view taken along the line 3—3 of FIG. 2.

Referring specifically to FIGS. 2 and 3 which depict the lower portion of the furnace section 12, the latter section is formed by a front wall 12*a*, a rear wall 12*b*, and two side walls 12*c* and 12*d* (FIG. 3). Each wall is formed by a plurality of water wall tubes 50 extending vertically in a spaced, parallel relationship with adjacent tubes being connected by continuous fins 52 extending between adjacent tubes. A refractory insulating material 54 extends immediately inside the tubes 50 and fins 52 and insulates the tubes from the heat generated in the furnace section 12. As shown in FIG. 2 the height of the refractory insulating material 54 is such that it extends just above the upper portion of the end of the conduit 48 extending into the furnace section 12. An opening 54*a* is provided in that portion of the insulating refractory material 54 extending adjacent the conduit 48 to allow the recycled solids to flow into the interior of the furnace section 12.

Figure 4:
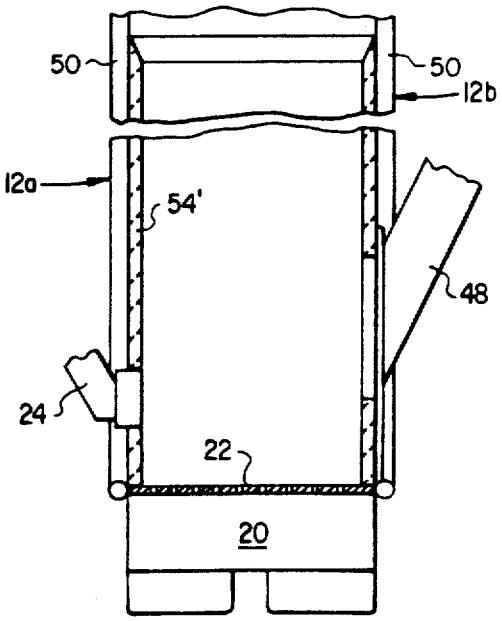
FIGS. 4 and 5 are views similar to FIG. 2 but showing different arrangements of the refractory insulation for the furnace section.

FIG. 4 is a view similar to FIG. 2 and identical components are given the same reference numerals. In the embodiment of FIG. 4, a refractory insulating material 54, is provided which extends higher than the refractory insulating material 54 in the embodiment of FIGS. 2 and 3. In the embodiment of FIG. 4 the insulation of the water wall tubes 50 from the heat generated in the furnace section 12 is greater due to the extended height of the refractory insulating material 54. This attendant decrease in heat absorption by the water passing through the tubes 50 will increase the furnace operating temperature when compared to the operating temperature of the furnace section 12 in FIG. 2.

Figure 5:
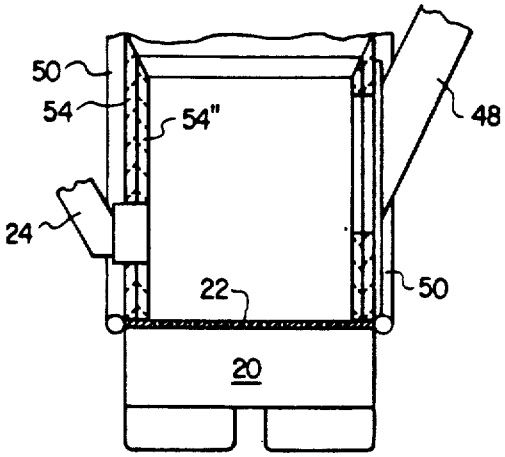

Another technique of decreasing the heat absorption of the water passing through the water wall tubes 50 is shown in FIG. 5 in which identical components are also given the same reference numeral. In this embodiment the insulating refractory material 54 of FIG. 2 is retained and another thickness or layer of insulating refractory material 54" is provided immediately within the layer of insulating refractory material 54 and in abutment therewith. This additional layer of insulating refractor material 54" further decreases the adsorption of the heat in the furnace section by the water passing through the tubes 50.

Thus according to the present invention, for a given design the absoprtion and therefore the operating temperature of the furnace can be precisely controlled by simply varying the height or thickness of the refractory insulating material.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed combustion method comprising the steps of fluidizing a bed of combustible material in a furnace at least a portion of which is formed by water tubes, passing water through said tubes to absorb heat from the combusted fuel and raise the temperature of said water, discharging a mixture of flue gases and entrained particulate material from the fluidized bed in said furnace, separating said entrained particulate material from said flue gases, passing said separated flue gases to a heat recovery section, passing said separated particulate material into the fluidized bed in said furnace, installing refractory material around said tubes to reduce the absorption of heat by said water, and selecting the amount of refractory material installed in accordance with the desired operating temperature of said furnace.

2. The method of claim 1 wherein the amount of heat absorbed by said water is sufficient to convert the water to steam.

3. The method of claim 1 wherein the height of the refractory material in said furnace is selected in accordance with the desired furnace operating temperature.

4. The method of claim 1 wherein the thickness of the refractory material in said furnace is selected in accordance with the desired furnace operating temperature.

* * * * *